US010724407B1

(12) United States Patent
Hoffman et al.

(10) Patent No.: US 10,724,407 B1
(45) Date of Patent: Jul. 28, 2020

(54) APPARATUSES FOR LUBRICATING CRANKTRAINS OF OUTBOARD MOTORS

(71) Applicant: Brunswick Corporation, Mettawa, WI (US)

(72) Inventors: Daniel P. Hoffman, Fond du Lac, WI (US); George D. Idzikowski, Lomira, WI (US)

(73) Assignee: Brunswick Corporation, Mettawa, IL (US)

( * ) Notice: Subject to any disclaimer, the term of this patent is extended or adjusted under 35 U.S.C. 154(b) by 206 days.

(21) Appl. No.: 15/869,266

(22) Filed: Jan. 12, 2018

(51) Int. Cl.

| | |
|---|---|
| ***F01M 11/02*** | (2006.01) |
| ***F02B 61/04*** | (2006.01) |
| ***F02B 75/22*** | (2006.01) |
| ***F02B 75/00*** | (2006.01) |
| ***F02F 7/00*** | (2006.01) |
| ***B63H 20/14*** | (2006.01) |
| *F01M 11/00* | (2006.01) |

(52) U.S. Cl.
CPC ..... *F01M 11/02* (2013.01); *B63H 20/14* (2013.01); *F02F 7/0012* (2013.01); *F02F 7/0053* (2013.01); *F01M 11/0004* (2013.01); *F01M 2011/022* (2013.01); *F01M 2011/026* (2013.01); *F02B 61/045* (2013.01)

(58) Field of Classification Search
CPC ... F02B 75/22; F02B 75/007; F01M 11/0004; F01M 2011/0033
See application file for complete search history.

(56) References Cited

U.S. PATENT DOCUMENTS

| | | | | |
|---|---|---|---|---|
| 4,771,745 | A | 9/1988 | Nakamura et al. | |
| 5,388,555 | A * | 2/1995 | Shiomi | B63H 21/305 123/195 P |
| 5,452,692 | A | 9/1995 | Spray et al. | |
| 5,613,470 | A * | 3/1997 | Shiomi | B63H 21/305 123/195 P |
| 6,058,900 | A | 5/2000 | Kusche et al. | |
| 6,067,952 | A | 5/2000 | Andrasko et al. | |
| 6,076,495 | A | 6/2000 | Takahashi et al. | |
| 6,286,476 | B1 | 9/2001 | Hiraoka et al. | |
| 7,198,019 | B1 | 4/2007 | Belter | |
| 9,457,881 | B1 | 10/2016 | Belter et al. | |
| 2002/0111090 | A1* | 8/2002 | Tsubouchi | F01M 11/12 440/88 L |
| 2004/0177826 | A1* | 9/2004 | Duwel | F01M 11/0004 123/196 R |
| 2005/0279316 | A1* | 12/2005 | Rice | F01M 11/0004 123/195 C |
| 2017/0044941 | A1* | 2/2017 | Nishi | F02B 67/00 |

* cited by examiner

*Primary Examiner* — Sizo B Vilakazi
(74) *Attorney, Agent, or Firm* — Andrus Intellectual Property Law, LLP

(57) ABSTRACT

An outboard motor comprises an engine block having vertically-aligned first and second banks of cylinders that extend from each other in a V-shape, a vertically-extending central drain passage located below the first bank of cylinders and being configured to drain lubricant to an underlying sump, a vertically-extending crankshaft, and a central deflector located between the first and second banks of cylinders. The central deflector extends from the engine block towards the crankshaft and being configured to deflect lubricant away from the crankshaft to the central drain passage.

20 Claims, 7 Drawing Sheets

APPARATUSES FOR LUBRICATING CRANKTRAINS OF OUTBOARD MOTORS

FIELD

The present disclosure relates to outboard motors and more particularly to apparatuses for lubricating cranktrains of outboard motors.

BACKGROUND

The following U.S. patents are incorporated herein by reference:

U.S. Pat. No. 9,616,987 discloses a marine engine including a cylinder block having first and second banks of cylinders that are disposed along a longitudinal axis and extend transversely with respect to each other in a V-shape so as to define a valley there between. A catalyst receptacle is disposed at least partially in the valley and contains at least one catalyst that treats exhaust gas from the marine engine. A conduit conveys the exhaust gas from the marine engine to the catalyst receptacle. The conduit receives the exhaust gas from the first and second banks of cylinders and conveys the exhaust gas to the catalyst receptacle. The conduit reverses direction only once with respect to the longitudinal axis.

U.S. Pat. No. 7,198,019 discloses a lubricating system for a marine engine having a lubrication deflector which extends from the cylinder block of the engine toward rotating surfaces of a crankshaft and/or connecting rod. A lubrication passage is provided as an integral part of a cylinder block of the outboard motor to direct a flow of liquid lubricant away from the lubrication deflectors and downwardly toward a lubrication reservoir, or sump.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

An outboard motor comprises an engine block having vertically-aligned first and second banks of cylinders that extend from each other in a V-shape, a vertically-extending central drain passage located below the first bank of cylinders and configured to drain lubricant to an underlying sump, a vertically-extending crankshaft, and a central deflector located between the first and second banks of cylinders. The central deflector extends from the engine block towards the crankshaft and is configured to deflect lubricant away from the crankshaft to the central drain passage.

DETAILED DESCRIPTION OF THE DRAWINGS

Figure 1A:
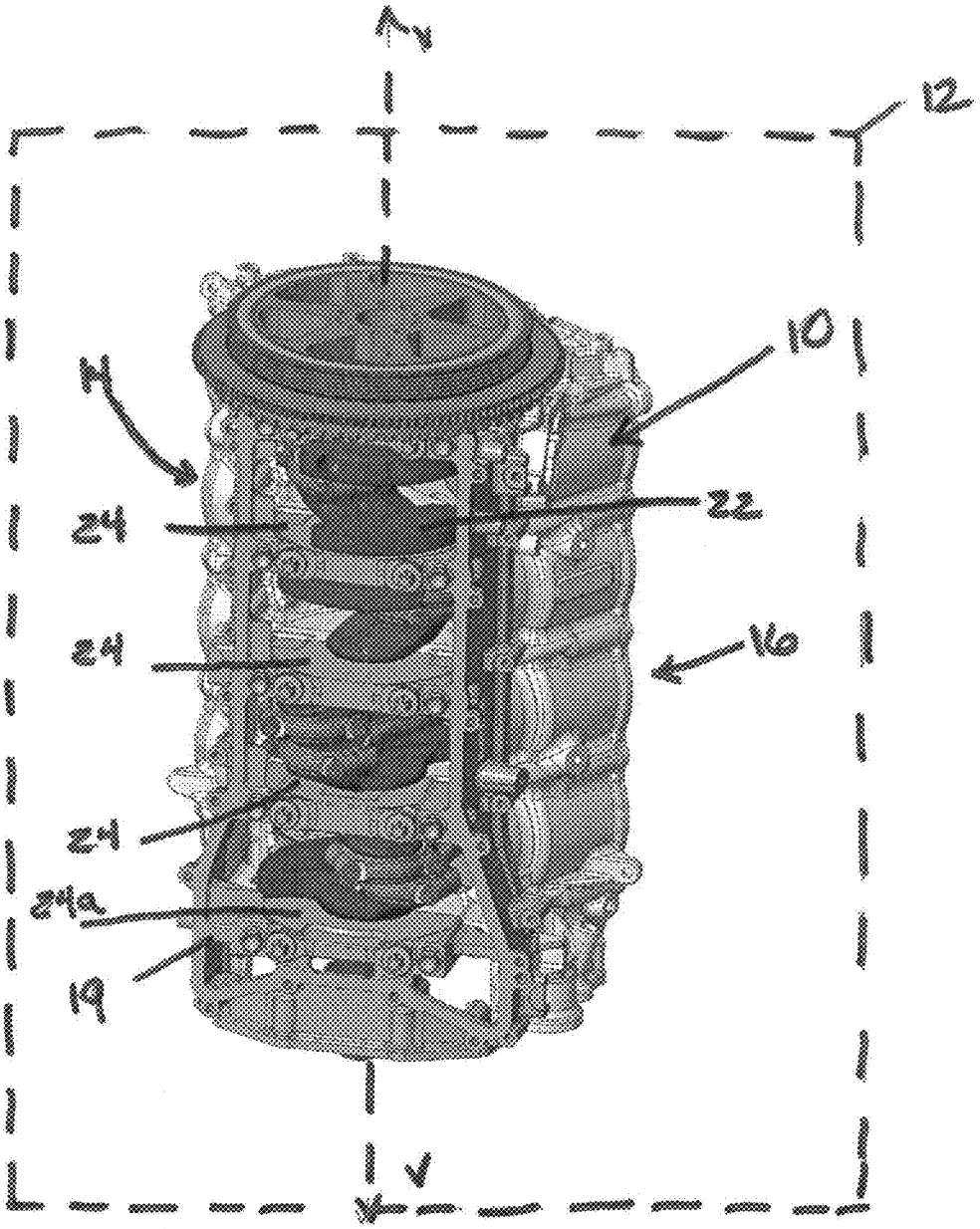
FIGS. 1A and 1B are perspective views of an engine block having vertically-aligned first and second banks of cylinders that extend from each other in a V-shape.
Figure 1B:
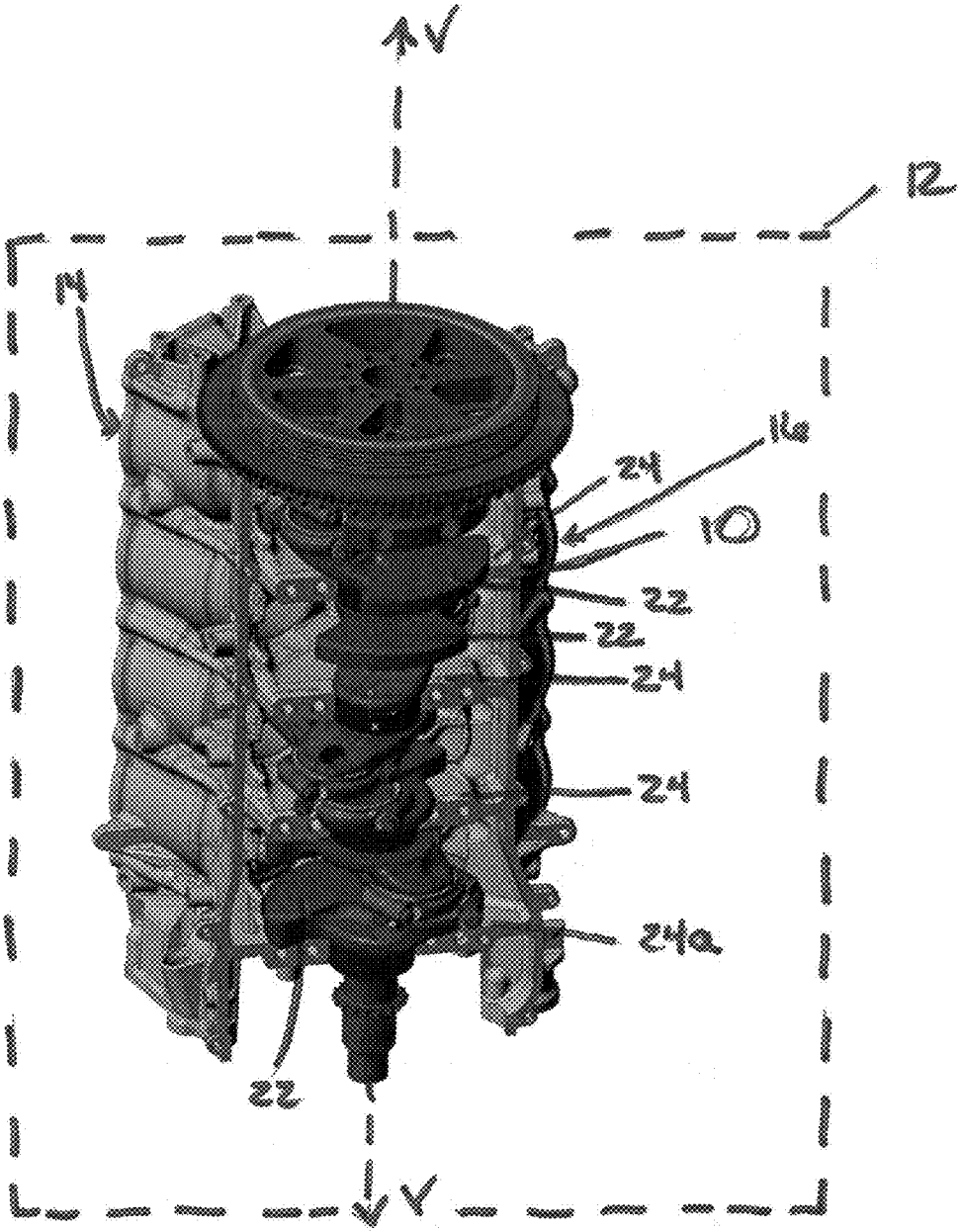
Figure 2:
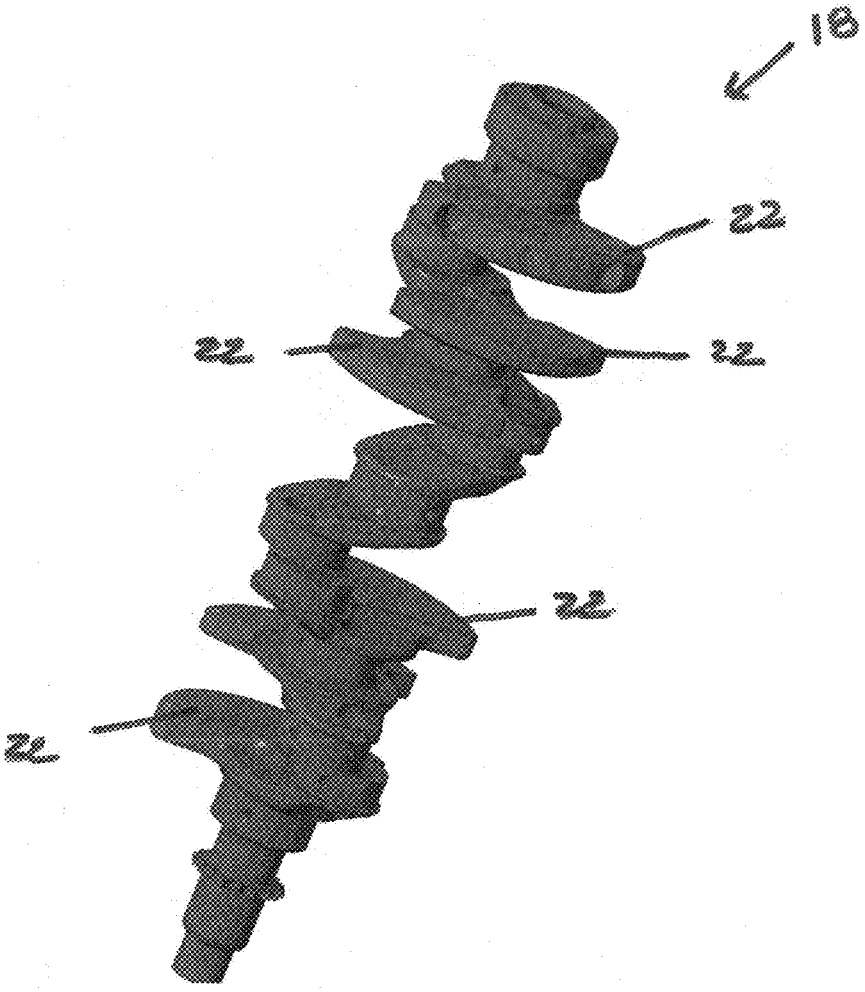
FIG. 2 is a perspective view of a crankshaft for the engine block shown in FIG. 1.

FIGS. 1A and 1B depicts an engine block 10 for an outboard motor 12. The engine block 10 extends vertically with respect to an axis V and has first and second vertically-aligned banks of cylinders 14, 16 which extend horizontally from each other in a V-shape, as shown. As is conventional, combustion within the banks of cylinders 14, 16 causes reciprocating movement of associated pistons 15 (see FIG. 5) and connecting rods 17 which in turn causes rotation of a vertically extending crankshaft 18 about the axis V. As conventional, the crankshaft 18 is disposed in a crankcase 19 on the engine block 10 and is supported with respect to the engine block 10 by a plurality of bearings 24. The crankshaft 18 has a plurality of counterweights 22 which rotate with the crankshaft 18 about the axis V, all as is conventional.

Figure 3:
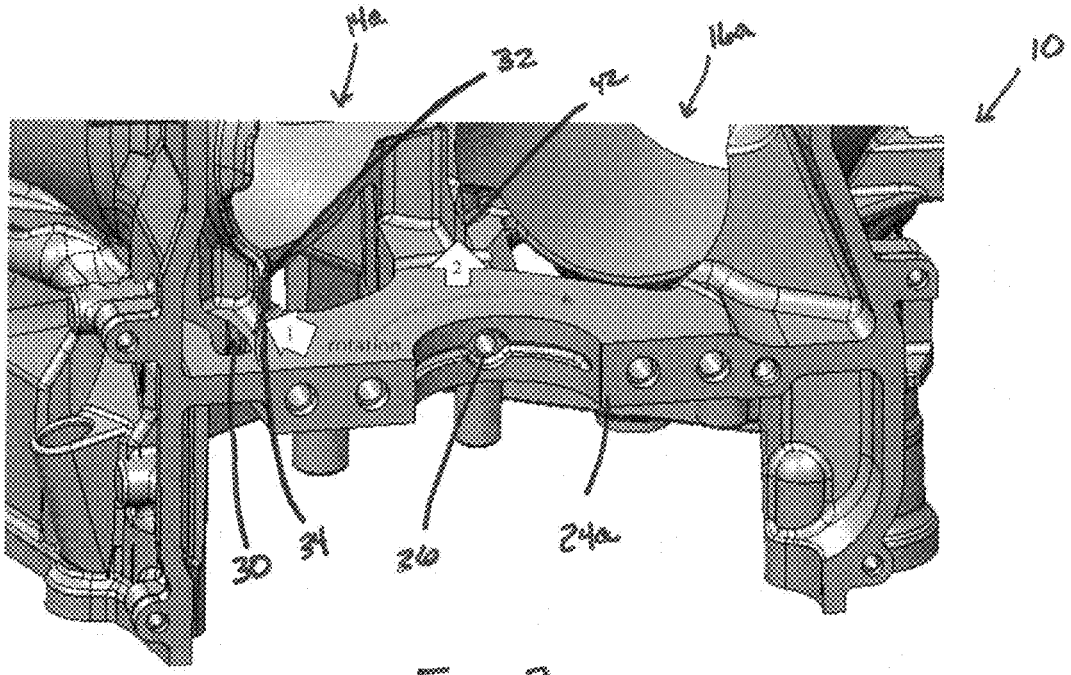
FIG. 3 is a front view of a portion of the lowermost cylinders of the engine block, particularly showing an outer deflector configured to deflect lubricant from a crankshaft towards an outer drain passage, and a central deflector configured to deflect lubricant from the crankshaft to a central drain passage.

FIG. 3 is a partial view of the lowermost portion of the engine block 10, particularly showing the lowermost cylinders 14*a*, 16*a* in the banks of cylinders 14, 16 and the lowermost bearing 24 a in the plurality of bearings 24. It can be seen that the banks of cylinders 14, 16 are slightly vertically offset from each other, such that for example the lowermost cylinder 14*a* is located slightly vertically higher than the lowermost cylinder 16*a*. This offset configuration facilitates location of the connecting rods 17 (see FIG. 5) with respect to the center planes of the respective cylinders 14, 16 and connection to the crankshaft 18 in a stacked, interdigitated configuration. The lowermost bearing 24*a* is located below the lowermost cylinders 14*a*, 16*a*.

Each bearing 24 has several lubricant passages (not all are shown, e.g. see 26) for conducting lubricant from an underlying sump to the interior of the crankcase, for lubricating the crankshaft 18 and the pistons 15 (see FIG. 5) disposed in the banks of cylinders 14, 16. Not all the lubricant passages are shown in the figures, however in general the lubricant passages receive pressurized lubricant (e.g. oil) from a lubricant pump and convey the lubricant to the crankcase 19 for lubricating each of the plurality of bearings 24. Typically, the lubricant is sprayed onto the crankshaft 18 via the passages and then is agitated inside the crankcase 19 by the revolving crankshaft 18. The lubricant drains by gravity to the lowermost portion of the engine block 10, shown in FIG. 3.

Thus, in use, lubricant is pumped into the crankcase 19 via the passages in the plurality of bearings 24. The rotating crankshaft 18 agitates the lubricant and causes the lubricant to generally travel with (i.e. follow or be flung by) the crankshaft 18 generally in the direction of rotation of the crankshaft. The lubricant tends to stick to the rotating crankshaft 18 and/or travel and/or get flung into a revolving path alongside the outer surfaces 36 of the crankshaft.

Through research and experimentation, the present inventors have determined that lubricant in the above-described engine configuration tends to drain by gravity and according to the direction of rotation of the crankshaft 18, and collect, particularly, in the lowermost cylinder 16*a*. This can cause frictional losses in the system, which is disadvantageous. The present disclosure provides a unique solution to this problem.

Figure 4:
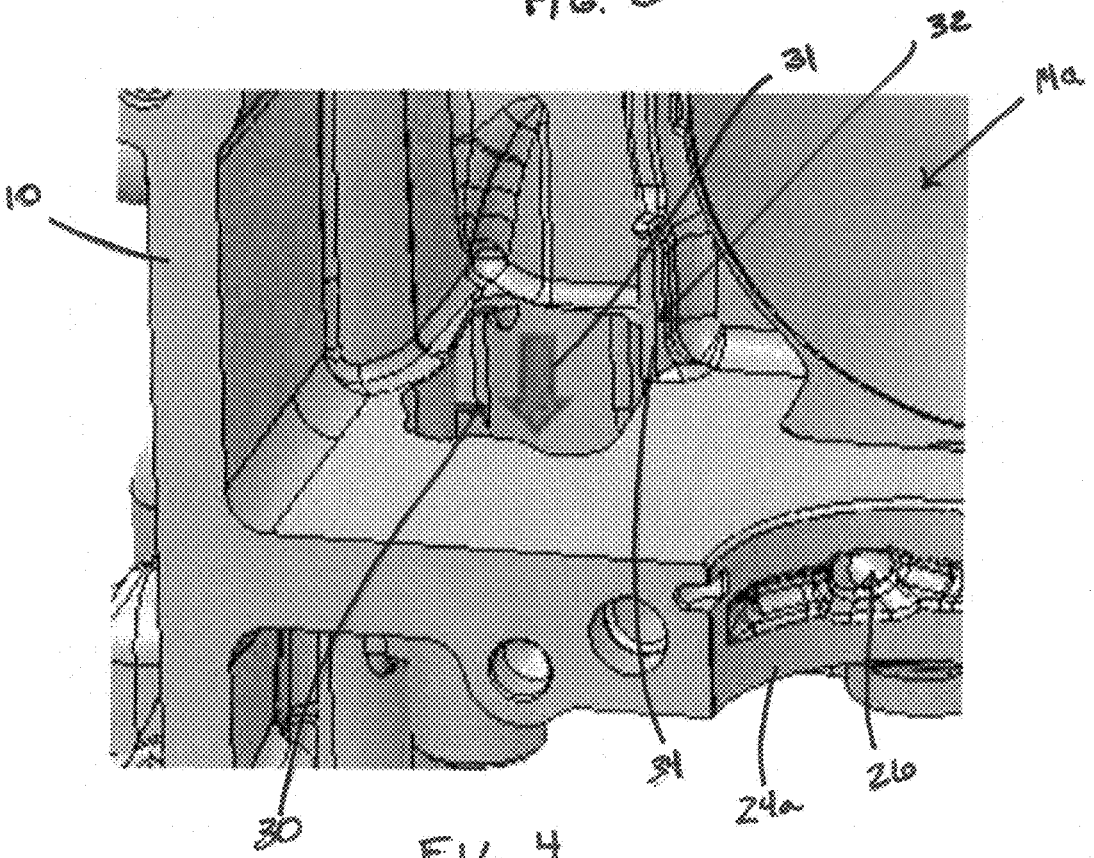
FIG. 4 is a closer view of the outer drain passage.
Figure 5:
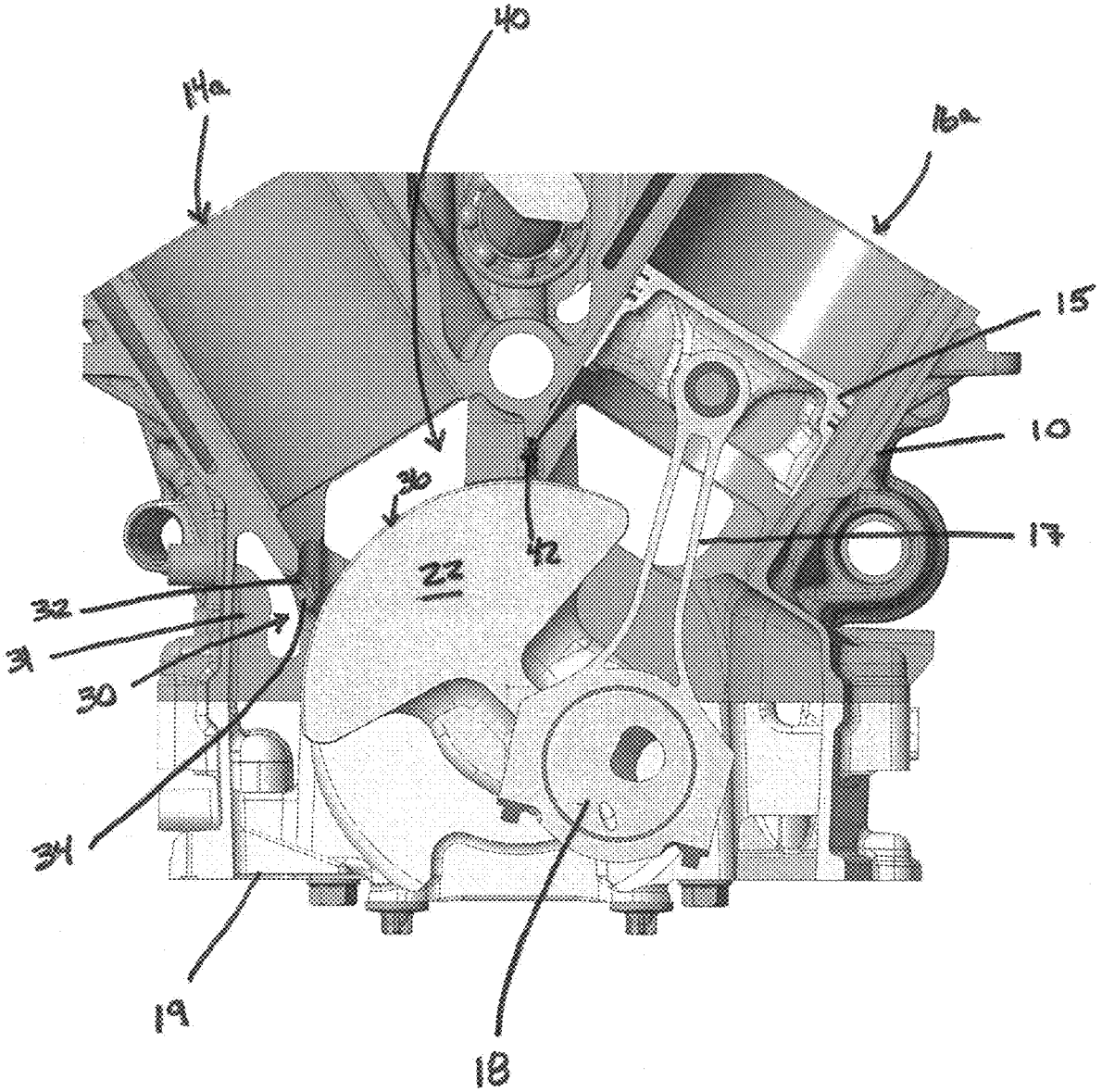
FIG. 5 is a sectional view looking down at the lowermost cylinders in the engine block, showing the crankshaft with counterweight rotating proximate to the outer and central deflectors.
Figure 6:
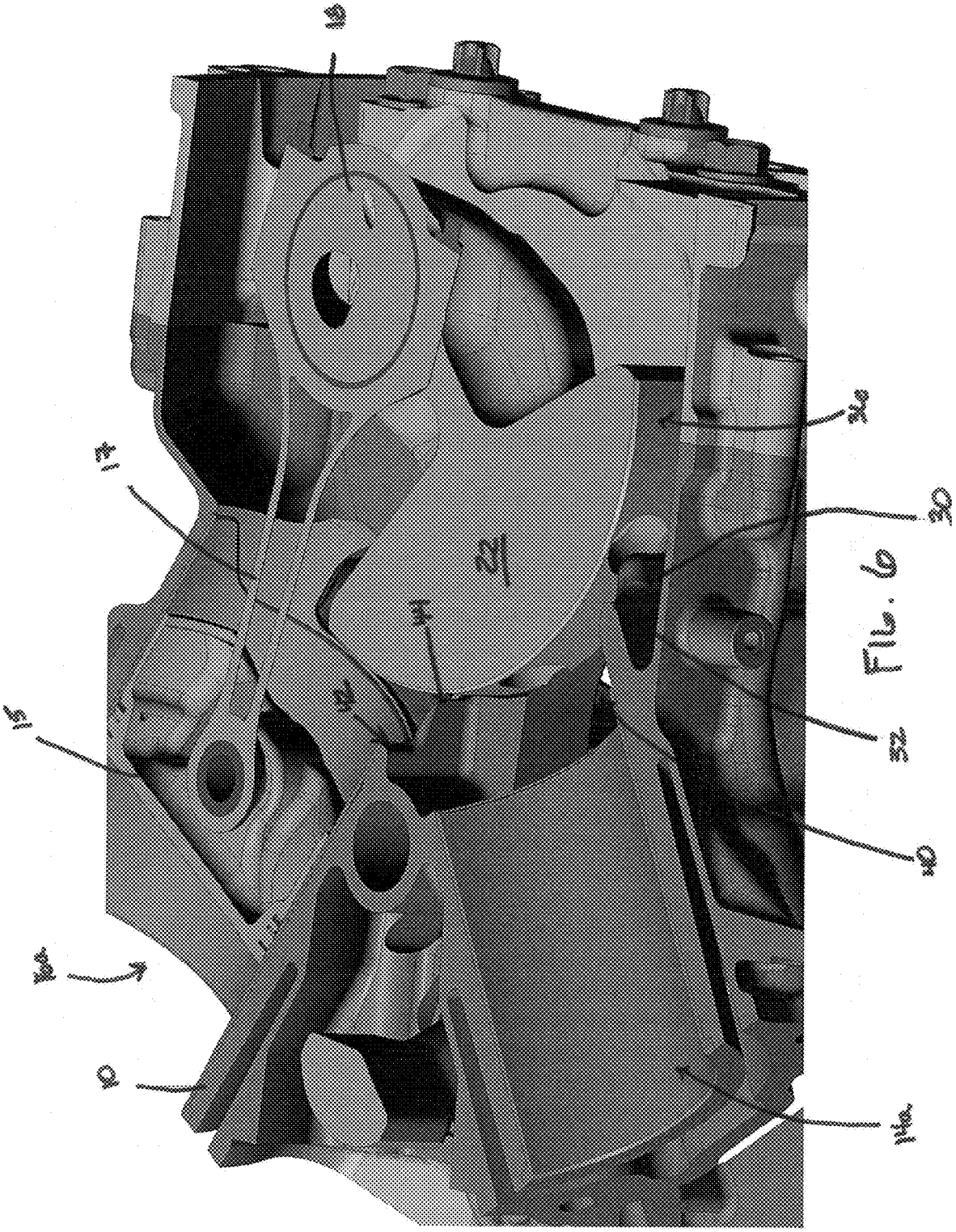
FIG. 6 is another perspective view of what is shown in FIG. 5.

As shown in FIGS. 3-5, the engine block 10 includes a vertically-extending outer drain passage 30, which is located radially outside of the lowermost cylinder 14*a*. The outer drain passage 30 is configured to drain the lubricant that settles by gravity in the crankcase 19 to the underlying sump, as shown by arrow 31 in FIG. 4. An outer deflector 32 is located alongside and above the outer drain passage 30 and is configured to deflect the lubricant from alongside the surfaces 36 of the crankshaft 18 to the outer drain passage 30, as the surfaces 36 of the crankshaft 18 rotate past the outer deflector 32. The outer drain passage 30 is formed between the sidewalls 31 of the engine block 10 and the outer deflector 32. As shown in FIGS. 4 and 5, the outer deflector 32 is formed by a wall of the engine block 10 that projects towards the crankshaft 18. The outer deflector 32 has an inner end surface 34 that faces the crankshaft 18 and is located adjacent to and proximate to the outer surface 36 of the counterweight 22 on the crankshaft 18 as the counterweight 22 rotates past the outer deflector 32. The inner end surface 34 faces the crankshaft 18 and extends generally parallel to the axis V. Referring to FIG. 6, the inner end surface 34 has a lower flat vertical profile and an upper curved vertical profile that extends away from the flat vertical profile and away from the crankshaft 18. The outer deflector 32 has side surfaces that extend away from and on opposite sides of the inner end surface 50, away from the crankshaft 18.

Figure 7:
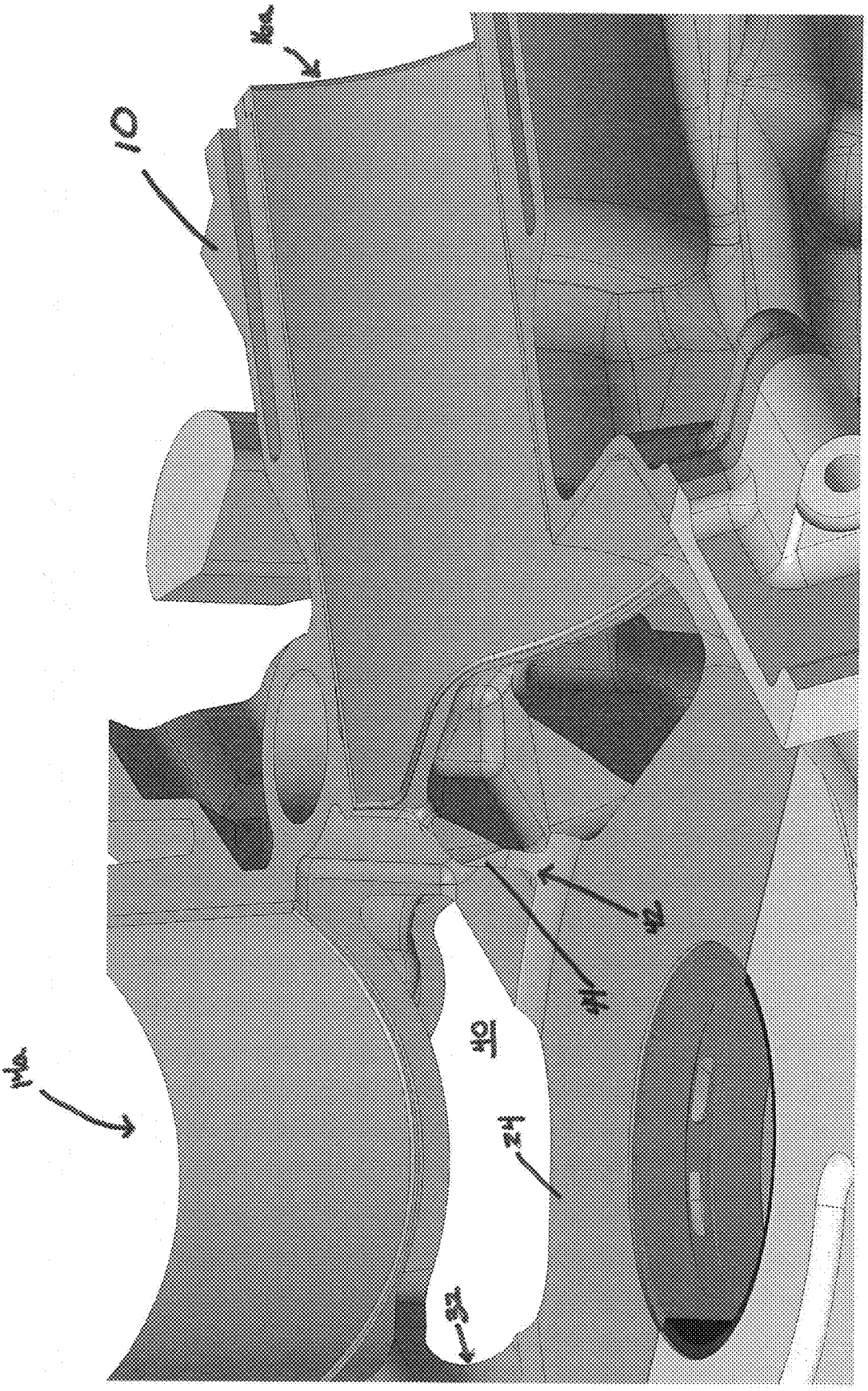
FIG. 7 is an opposite perspective view of the central deflector.

Referring to FIGS. 5-7, engine block 10 also has a central drain passage 40 located below the first bank of cylinders 14. The central drain passage 40 vertically extends through the engine block 10 and is configured to drain the lubricant that settles by gravity in the crankcase 19 to the underlying sump. A central deflector 42 is located between the first and second banks of cylinders 14, 16 and is configured to deflect lubricant from the counterweight 22 of the crankshaft 18 as the counterweight 22 rotates past the central deflector 42. The central drain passage 40 is formed between the outer deflector 32 and the central deflector 42, and below the lowermost cylinder 14*a*. The central deflector 42 is defined by a wall that vertically extends between the lowermost cylinders 14*a*, 16*a* and projects from the engine block 10 towards the crankshaft 18. The central deflector 42 has an inner end surface 44 that faces the crankshaft 18 and is located adjacent to and proximate to the outer surface 36 of the counterweight 22 on the crankshaft 18 as the counterweight 22 rotates past the outer deflector 32. The central deflector 42 is configured to deflect a portion of the lubricant carried alongside the surface 36 of the crankshaft 18 to the central drain passage 40 so that the lubricant is not carried to the lowermost cylinder 16*a* in the second bank of cylinders 16. The inner end surface 44 faces the crankshaft 18 and extends generally parallel to the axis V. The inner end surface 44 has a lower flat vertical profile and an upper curved vertical profile that extends away from the flat vertical profile 58 and away from the crankshaft 18. The central deflector 42 has side surfaces that extend away from and on opposite sides of the inner end surface 44, away from the crankshaft 18.

In use, pressurized lubricant is pumped into the crankcase via the passages 26 in the plurality of bearings 24. The rotating crankshaft 18 agitates the lubricant and causes the lubricant to travel generally in the direction of rotation of the crankshaft 18. The lubricant tends to stick to the rotating crankshaft 18 and/or travel or get flung into a revolving path alongside the outer surfaces 36 of the crankshaft. According to the concepts presently disclosed, the outer surface 36 of the crankshaft 18 first rotates past the outer deflector 32, which deflects a portion of the lubricant that is traveling with or being flung alongside the outer surface 36 into the outer drain passage 30. The outer surface 36 of the crankshaft 18 continues to rotate past the lowermost cylinder 14*a* in the first bank of cylinders 14, and then past the central deflector 42, which deflects another portion of the lubricant that is travelling with or being flung alongside the outer surface 43 into the central drain passage 40. The outer surface 36 of the crankshaft continues to rotate past the lowermost cylinder 16*a* in the second bank of cylinders 16. This process repeats upon each rotation of the crankshaft 18 about the axis V. Thus, the lubricant carried or flung by the rotating crankshaft 18 during its rotation is efficiently deflected from the crankshaft 18 to the outer and central drain passages 30, 40, instead of migrating into the lowermost cylinder 16*a* in the second bank of cylinders 16. During experimentation, this was found to advantageously limit the frictional losses that otherwise occurred in the system In the present description, certain terms have been used for brevity, clearness and understanding. No unnecessary limitations are to be implied therefrom beyond the requirement of the prior art because such terms are used for descriptive purposes only and are intended to be broadly construed. The different systems, methods and apparatuses described herein may be used alone or in combination with other systems, methods and apparatuses. Various equivalents, alternatives and modifications are possible within the scope of the appended claims.

What is claimed is:

1. An outboard motor comprising an engine block having vertically-aligned first and second banks of cylinders that extend from each other in a V-shape, a vertically-extending central drain passage located below the first bank of cylinders and configured to drain lubricant to an underlying sump, a vertically-extending crankshaft, and a central deflector located between the first and second banks of cylinders, the central deflector extending from the engine block towards the crankshaft and being configured to deflect lubricant away from the crankshaft to the central drain passage.

2. The outboard motor according to claim 1, wherein an outermost surface of the crankshaft passes by the central deflector as the crankshaft rotates such that the central deflector deflects lubricant away from the outermost surface.

3. The outboard motor according to claim 2, wherein the crankshaft comprises a plurality of counterweights, and wherein the outermost surface of the crankshaft is an outermost surface of one of the counterweights in the plurality of counterweights.

4. The outboard motor according to claim 2, wherein the central deflector is located between a lowermost cylinder in the first bank of cylinders and a lowermost cylinder in the second bank of cylinders.

5. The outboard motor according to claim 4, wherein the first and second banks of cylinders and are vertically offset with respect to each other so that the lowermost cylinder in the first bank of cylinders is located vertically higher than the lowermost cylinder in the second bank of cylinders.

6. The outboard motor according to claim 4, further comprising a plurality of bearings that support rotation of a crankshaft with respect to the first and second banks of cylinders, wherein the central deflector is located above a lowermost bearing in the plurality of bearings, the lowermost bearing being disposed below the lowermost cylinders in the first and second banks of cylinders.

7. The outboard motor according to claim 6, wherein the central deflector is configured to deflect a portion of the lubricant carried on the crankshaft to the central drain passage so that the portion of the lubricant is not carried by the crankshaft to the lowermost cylinder in the second bank of cylinders.

8. The outboard motor according to 7, wherein upon combustion in the engine block, the crankshaft rotates past lowermost cylinder in the first bank of cylinders, then past the central deflector surface, and then past the lowermost cylinder in the second bank of cylinders.

9. The outboard motor according to claim 7, wherein the central deflector comprises an inner end surface that faces the crankshaft and side surfaces that extend away from and on opposite sides of the inner end surface towards the respective lowermost cylinders in the first and second banks of cylinders.

10. The outboard motor according to claim 9, wherein the inner end surface has a curved vertical profile.

11. The outboard motor according to claim 1, further comprising an outer deflector configured to deflect lubricant from the crankshaft to an vertically-extending outer drain passage, which is located on an opposite side of a lowermost cylinder in the first bank of cylinders with respect to a lowermost cylinder in the second bank of cylinders.

12. The outboard motor according to 11, wherein as a result of combustion in the engine block, the crankshaft rotates first past the outer deflector, then past the lowermost cylinder in the first bank of cylinders, then past the central deflector, and then past a lowermost cylinder in the second bank of cylinders.

13. The outboard motor according to claim 12, wherein the central deflector is configured to deflect the lubricant to the central drain passage so that the lubricant is not carried by the crankshaft to the lowermost cylinder in the second bank of cylinders.

14. The outboard motor according to claim 12, wherein the outer deflector and central deflector each comprises inner end surfaces that face the crankshaft and extend parallel to each other.

15. An outboard motor comprising:

an engine block having vertically-aligned first and second banks of cylinders that horizontally extend from each other in a V-shape;

a vertically-extending crankshaft;

a central drain passage located below the lowermost cylinder in the first bank of cylinders, the central drain passage being configured to drain lubricant to an underlying sump;

an outer drain passage located on an opposite side of a lowermost cylinder in the first bank of cylinders with respect to a lowermost cylinder in the second bank of cylinders, the outer drain passage being configured to drain lubricant to an underlying sump;

an outer deflector configured to deflect lubricant away from the crankshaft to the outer drain passage; and a central deflector configured to deflect lubricant away from the crankshaft to the central drain passage, wherein upon combustion in the engine block, an outer surface of the crankshaft rotates first past the outer deflector, then past the lowermost cylinder in the first bank of cylinders, then past the central deflector, and then past the lowermost cylinder in the second bank of cylinders, such that lubricant carried by the crankshaft is deflected from the crankshaft to the outer and central drain passages instead of being carried to a lowermost cylinder in the second bank of cylinders.

16. The outboard motor according to claim 15, wherein the first and second banks of cylinders and are vertically offset with respect to each other so that the lowermost cylinder in the first bank of cylinders is located vertically higher than the lowermost cylinder in the second bank of cylinders.

17. The outboard motor according to claim 16, further comprising a plurality of bearings that support rotation of a crankshaft with respect to the first and second banks of cylinders, wherein the central deflector is located above a lowermost bearing in the plurality of bearings, the lowermost bearing being disposed below the lowermost cylinders in the first and second banks of cylinders.

18. The outboard motor according to claim 17, wherein the central deflector comprises an inner end surface that faces the crankshaft and side surfaces that extend away from and on opposite sides of the inner end surface towards the respective lowermost cylinders in the first and second banks of cylinders.

19. The outboard motor according to claim 18, wherein the inner end surface has a curved vertical profile.

20. The outboard motor according to claim 15, wherein the outer deflector and central deflector each comprises inner end surfaces that face the crankshaft and vertically extend parallel to each other.

* * * * *